US005732438A

United States Patent [19]

Tuvin et al.

[11] Patent Number: 5,732,438

[45] Date of Patent: Mar. 31, 1998

[54] DEVICE FOR STORING NOZZLES FOR A VACUUM CLEANER

[75] Inventors: Lars Tuvin, Knivsta; Lars Kilström, Täby, both of Sweden

[73] Assignee: Aktiebolaget Electrolux, Stockholm, Sweden

[21] Appl. No.: 651,253

[22] Filed: May 23, 1996

[30] Foreign Application Priority Data

Jun. 8, 1995 [SE] Sweden ..... 9502102

[51] Int. Cl.[6] ..... A47L 9/00

[52] U.S. Cl. ..... 15/323; 15/410

[58] Field of Search ..... 15/323, 410

[56] References Cited

U.S. PATENT DOCUMENTS

| | | | |
|---|---|---|---|
| 2,450,172 | 9/1948 | Stoner . | |
| 3,872,538 | 3/1975 | Crouser | 15/323 |
| 4,715,083 | 12/1987 | Harris et al. | 15/323 |
| 4,720,890 | 1/1988 | Jacob | 15/323 |
| 4,761,850 | 8/1988 | Romeo et al. | 15/323 |
| 5,233,722 | 8/1993 | McKnight et al. | 15/323 |
| 5,247,719 | 9/1993 | Wareham et al. | 15/323 |

FOREIGN PATENT DOCUMENTS

| | | |
|---|---|---|
| 3242429 | 5/1983 | Germany . |
| 408263 | 6/1979 | Sweden . |

*Primary Examiner*—Chris K. Moore

*Attorney, Agent, or Firm*—Pearne, Gordon, McCoy & Granger LLP

[57] ABSTRACT

A device for storing nozzles or tools for a vacuum cleaner. The cleaner includes a tube handle (12) to which a tube shaft (13) with a floor nozzle (14) can be secured. The tube handle (12) is attached to a vacuum cleaner hose (11) which is connected to a vacuum cleaner body or source. The device includes a holder (15) which releasably retains several accessories (27,34,39). The holder is located on or adjacent the tube handle (12).

20 Claims, 3 Drawing Sheets

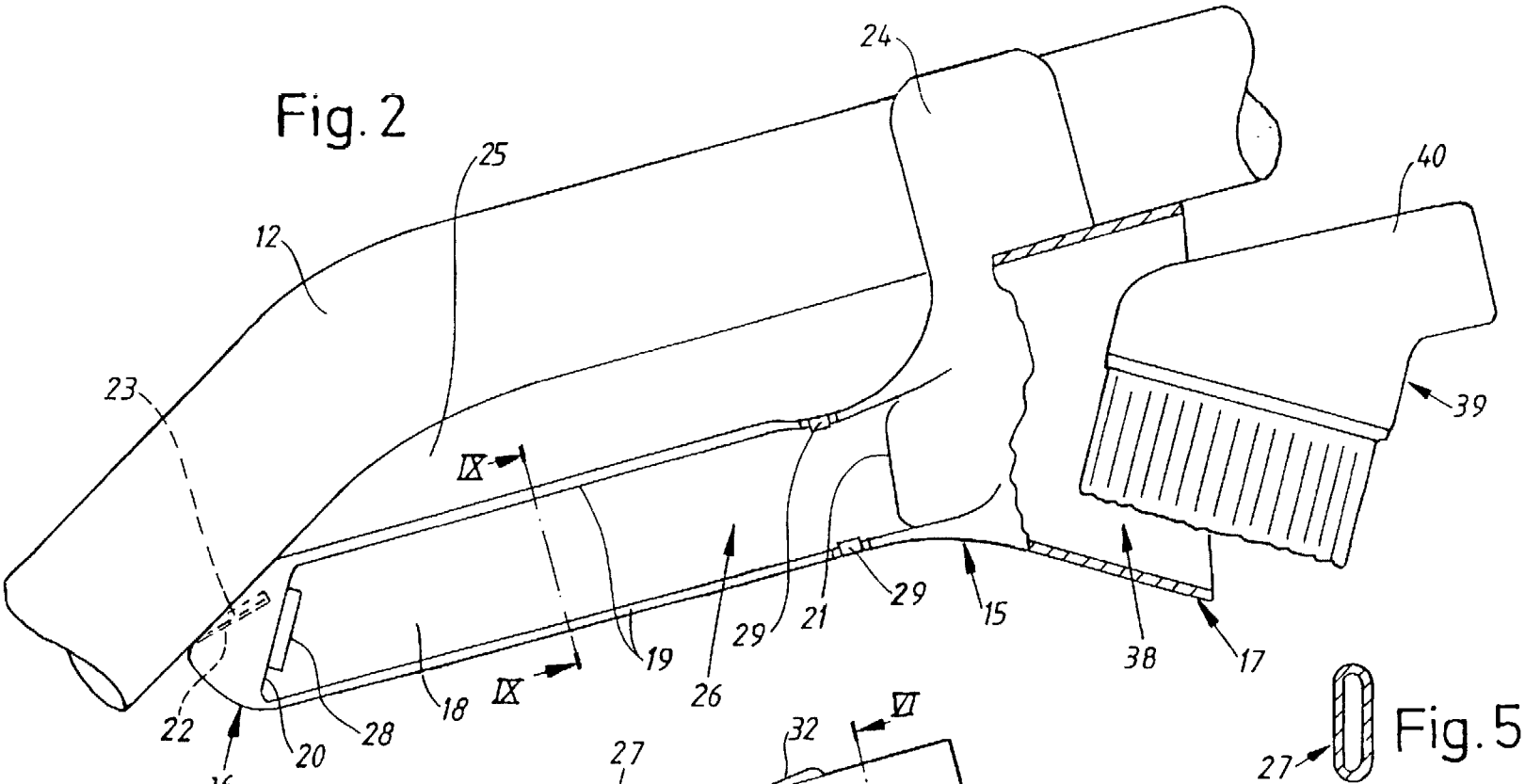
Fig. 2
Fig. 5
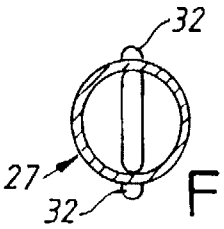
Fig. 6
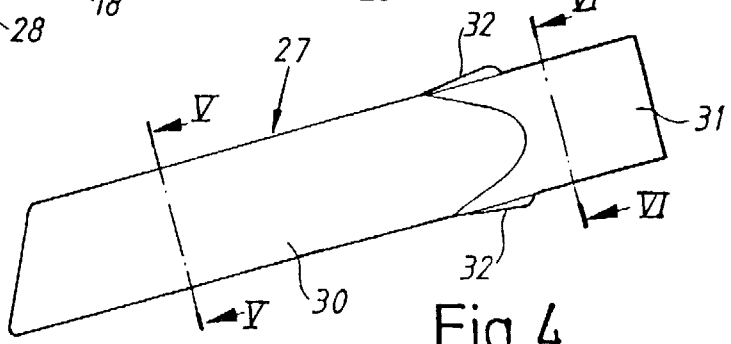
Fig. 4

DEVICE FOR STORING NOZZLES FOR A VACUUM CLEANER

BACKGROUND OF THE INVENTION

1. Field of the Invention

The present invention relates to a device for storing nozzles for a canister-type vacuum cleaner.

2. Description of Related Art

Canister-type vacuum cleaners conventionally include a tube handle to which a tube shaft with a floor nozzle can be applied, and which is attached to a vacuum cleaner hose which is connected to a vacuum cleaner body. When using such a vacuum cleaner, it is common to store accessories, such as small nozzles which are temporarily or intermittently used during the cleaning operation, on or within the vacuum cleaner shell in order to be accessible to the user without it being necessary for the operator to move too far away from the vacuum cleaner. Switching or exchanging nozzles is nevertheless troublesome for many people, in particular for elderly people, since the vacuum cleaner shell is generally at the same level as the floor, and therefore requires the operator to bend over to reach the nozzles.

It is also previously known to store a brush nozzle on a hook arranged on the tube shaft when using a vacuum cleaner of the above-described type, which means that the brush nozzle is easily accessible for the operator. However, in this case the other cleaning tools have to be stored on or in the vacuum cleaner shell or separate from the vacuum cleaner. Therefore, there exists a need in the art for a device which permits convenient storage and access to multiple cleaning nozzles or cleaning tools commonly utilized during cleaning of household floors, floor coverings, upholstery, and furniture.

SUMMARY OF THE INVENTION

One purpose of the present invention is to eliminate the disadvantages mentioned above and to create a device which makes it possible to conveniently store and access a plurality of the small nozzles or cleaning tools belonging to the vacuum cleaner.

In accordance with the present invention, a nozzle holder is operable to releasably store a plurality of small nozzles or cleaning tools. The holder is adapted to be attached to a tube handle of the vacuum cleaner assembly, and therefore, locates a plurality of cleaning nozzles or tools at a convenient and easily accessible location for the operator.

BRIEF DESCRIPTION OF THE DRAWINGS

These and further features of the present invention will be apparent with reference to the following description and drawings, wherein:

FIG. 2 shows a side elevational view of the nozzle storage device in an enlarged scale and in a partly broken view with a brush nozzle accessory;

FIG. 4 shows a tube nozzle which is placed on one side of the nozzle storage device (FIG. 2);

FIGS. 5 and 6 respectively show sections on the lines V—V and VI—VI in FIG. 4;

DETAILED DESCRIPTION OF THE PREFERRED EMBODIMENT

Figure 1:
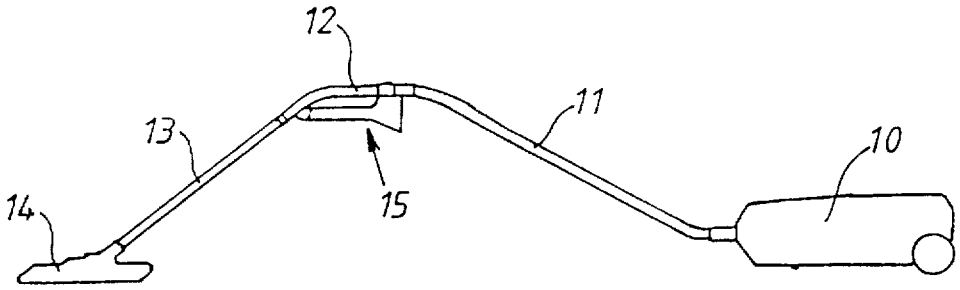
FIG. 1 shows a vacuum cleaner incorporating a nozzle storage device according to the present invention.

FIG. 1 shows a vacuum cleaner having a vacuum cleaner body 10 with a conventional fan unit and a dust bag (not shown). The vacuum cleaner includes, in addition to the cleaner body 10, a vacuum cleaner assembly comprising a hose 11, a tube handle 12, a tube shaft 13, a nozzle 14, and a holder 15.

One end of the hose 11 is connected to the body 10, while the opposite end of the hose is releasably secured to the tube handle 12. The tube handle 12 is connected to the tube shaft 13 which, in turn, supports the vacuum cleaner nozzle 14. The tube handle 12 is provided with the cleaning tool or nozzle holder 15, which will be described more fully hereafter.

Figure 3:
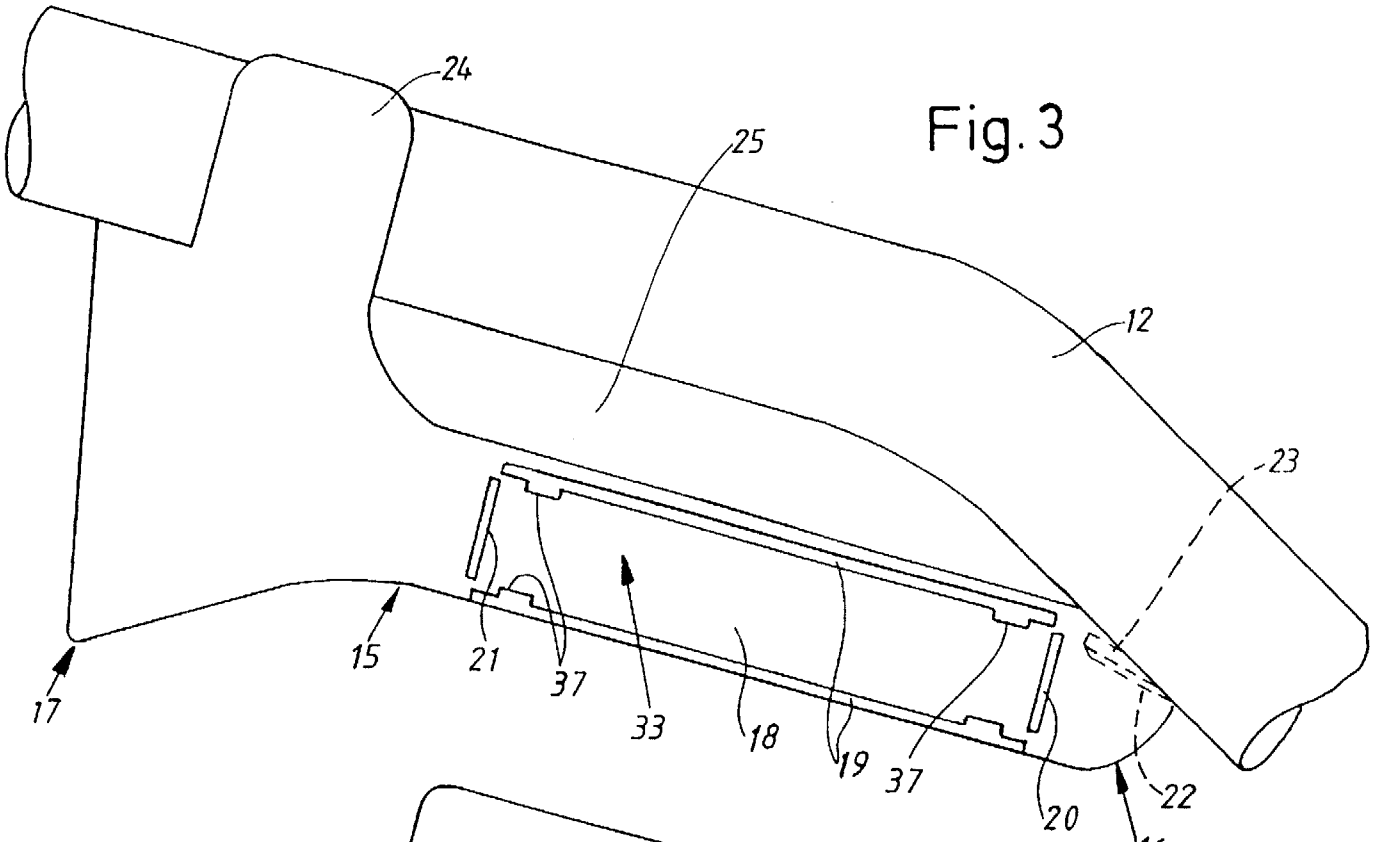
FIG. 3 shows an opposite side elevational view of the device according to the present invention.

With reference to FIGS. 2 and 3, the holder 15 comprises a front part 16 and a rear part 17. The front part 16 is shaped as an elongated plate 18 having upper and lower side wall portions 19 and front and rear wall portions 20, 21. The rear part 17 is cup-shaped, as illustrated.

A free end of the front part 16 defines a recess 22 which receives a hook or tab 23 projecting from the tube handle 12, as illustrated. The rear part 17 has an arcuate, semicircular shaped resilient fastening means or clip 24 which can be snapped onto the tube handle 12 or onto a sleeve which normally connects the hose 11 to the tube handle 12. By inserting the hook 23 into the recess 22 and snapping the fastening means or clip 24 onto the tube handle 12, the holder 15 is firmly, yet removably, secured to the tube handle 12. A space or hollow opening or gap 25 is created between the tube handle 12 and the holder 15 into which the operator can insert his hand and thereby grip the tube handle 12 in the usual and expected manner.

Figure 9:
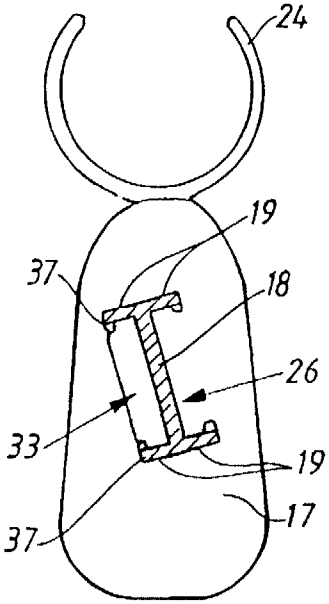
FIG. 9 shows a section on the line IX—IX in FIG. 2.

On one side of the front part 16 of the holder 15, as seen best in FIGS. 2 and 9, there is provided a first pocket 26 into which a tube nozzle 27 (FIG. 4) can be inserted and removably secured. The pocket 26 is defined by the plate 18, the upper and lower wall portions 19, the front wall portion 20, and the rear wall portion 21.

The upper and lower wall portions 19 cooperate with the front wall portion 20 to define a fastening device or means which is utilized to releasably retain a nozzle or cleaning tool within the first pocket 26. More specifically, a rearwardly extending shoulder 28 projects from the front wall portion 20. Resilient tongues 29 project toward one another from the upper and lower wall portions 19, as illustrated in FIGS. 2 and 9.

The tube nozzle 27 is shaped as a pipe or tube having a front portion 30 (FIG. 5) with a generally rectangular cross-section and a rear portion 31 (FIG. 6), with a generally circular cross-section. A diameter of the rear portion 31 is preferably slightly smaller than an inner diameter of the tube handle 12 so that the nozzle rear portion 31 can be inserted into the tube handle 12 in a frictional or interference-type fit when the tube shaft 13 has been removed therefrom. The tube nozzle 27 also has outwardly projecting knobs or stops 32 which prevent the tube nozzle 27 from being inserted too far into the tube handle 12.

The tube nozzle 27 is fixed in the pocket 26 by first placing the front portion 30 over the shoulder 28, and then pressing or pushing the rear portion 31 of the nozzle 27 toward the plate 18. Preferably, the shoulder 28 is shaped and dimensioned to fit within an opening provided at the front portion 30 of the nozzle 27. Alternatively, the shoulder 28 could be annular or ring-shaped and dimensioned to surround the front portion 30 of the nozzle. The tongues 29 flex outwardly as the nozzle 27 is pressed toward the plate 18, and partly surround the rear portion 32 of the nozzle to thereby retain the nozzle 27 within the pocket 26. In order to remove the nozzle 27 from the pocket 26, the nozzle 27 is merely pulled outwardly away from the plate 18.

Figure 7:
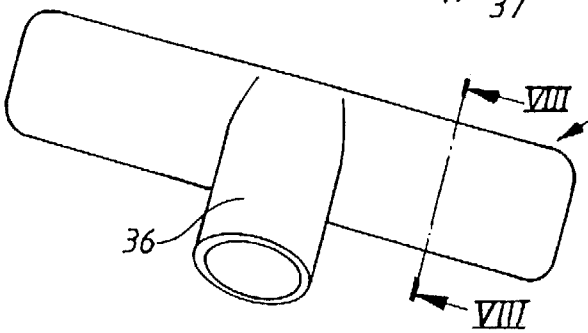
FIG. 7 shows a textile nozzle which is fixed on the other side of the nozzle storage device (FIG. 3)

On the opposite side of the front part 16 of the holder 15, as seen best in FIGS. 3 and 9, there is a second pocket 33 which is also defined by the plate 18 and the wall portions 19, 20 and 21. The upper and lower wall portions 19 have a plurality of resilient beads or projections 37 extending therefrom. The second pocket 33 is designed to receive a textile nozzle 34 (FIG. 7).

Figure 8:
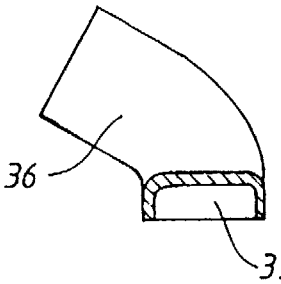
FIG. 8 shows a section on the line VIII—VIII in FIG. 7.

The textile nozzle 34 has an elongated air inlet opening 35 (FIG. 8) which is connected to a connection tube 36 to which the tube handle 12 can be connected. The outer diameter of the connection tube 36 is also preferably somewhat smaller than the inner diameter of the tube handle 12 to permit the tubes 12,36 to be fixed to each other by frictional engagement. In order to secure the nozzle 34 in the pocket 35, the nozzle 34 is arranged such that the air inlet opening 35 faces toward the plate 18. Thereafter, the nozzle 34 is pushed or pressed toward the plate 18, which means that the beads 37 projecting from the upper and lower wall portions 19 snap over and partially surround the nozzle 34 to maintain the nozzle in the pocket 33. In order to remove the nozzle 34 from the pocket 33, the nozzle 34 is merely pulled outwardly away from the plate 18.

The rear part 17 of the holder 15 is, as has been mentioned before, cup-shaped and forms or defines a third pocket 38 (FIG. 2) into which a brush nozzle 39 may be inserted and frictionally retained. Preferably, a connection tube 40 provided by the brush nozzle 39 has an outer diameter which is slightly less than the inner diameter of the tube handle 12 so that it can be frictionally retained on the tube handle 12.

The holder 15 has a width dimension and a length dimension. the width dimension of the holder 15, as seen in FIG. 9, is substantially the same as the width dimension of the tube handle 12, and therefore limits potential interference between the tube holder 15 and household furniture during movement of the vacuum cleaner during cleaning operations.

By means of the arrangement according to the present invention, several accessories are conveniently stored and accessible to the operator during the cleaning operation while permitting the operator to remove the holder 15, including all of the aforementioned nozzles 27,34,37 from the tube handle 12, if desired. Since the connecting parts of the nozzles have a small outer diameter as compared to the tube handle 12, the overall dimensions of the nozzles 27,34,37 are much smaller than conventional nozzles. Preferably, the holder 15 as well as the nozzles are made from plastics or similar light weight, durable materials.

It should be mentioned that the nozzle storage device according to the present invention can also be used for stationary vacuum cleaners, i.e., vacuum cleaners wherein the fan unit or vacuum source is connected, via permanent pipe installations, to several household sockets. Such stationary vacuum cleaners typically provide a vacuum cleaner assembly including an elongated hose which is connected, at one end, to one of the household sockets and, at an opposite end, to a tube handle. The tube handle is, in turn, connected to a tube shaft supporting a vacuum cleaner nozzle.

Therefore, it should be apparent that the nozzle holder 15 according to the present invention is of equal functionality with stationary vacuum cleaners as with the aforementioned canister-type vacuum cleaners.

Although the preferred embodiment of the present invention is particularly and specifically described in the foregoing, it should be clear that the present invention is capable of various modifications, rearrangements, and substitutions of parts without departing from the scope and spirit of the invention as defined by the claims appended hereto.

What is claimed is:

1. A vacuum cleaner assembly, comprising a device for storing nozzles, a tube handle (12), a tube shaft (13), a floor nozzle (14), and a hose (11), said hose being fluidly connected, at one end, to a vacuum source and, at an opposite end, to said tube handle (12), said tube handle (12) interconnecting said hose (11) with said tube shaft (13), said tube shaft having said floor nozzle (14) secured thereto, wherein said device for storing nozzles comprises a holder (15), said holder including a fastener (28,29,37,38) for releasably securing an accessory (27,34,39) to said holder, said holder being secured to said tube handle (12).

2. A vacuum cleaner assembly according to claim 1, wherein the holder (15) extends along a portion of the tube handle and is disposed relatively beneath the tube handle (12).

3. A vacuum cleaner assembly according to claim 1, wherein the holder (15) has a length dimension and a width dimension, said width dimension being substantially the same as a width dimension of the tube handle (12).

4. A vacuum cleaner assembly according to claim 1, wherein said tube handle (12) has an inner diameter, and a connecting part (31,36,40) of said accessory has an outer diameter, said outer diameter being less than said inner diameter to permit said connecting part to be received within said tube handle.

5. A vacuum cleaner assembly according to claim 1, wherein the holder (15) comprises an elongated, first part (16) on which the fastener (28,29,37) is located such that said accessory can be secured to a lateral side of the holder.

6. A vacuum cleaner assembly according to claim 5, wherein the first part (16) defines two pockets (26,33); said pockets being located on each side of an intermediate plate (18).

7. A vacuum cleaner assembly according to claim 5, wherein the holder further comprises a second part (17), said second part defining a pocket (38) which is adapted to receive and frictionally retain a brush nozzle.

8. A vacuum cleaner assembly according to claim 1, wherein the holder (15) is releasably secured to the tube handle (12).

9. A vacuum cleaner assembly according to claim 8, wherein the holder (15) has a front part (16) and a rear part (17), said holder being secured to the tube handle (12) at said front and rear parts (16 and 17 respectively), and wherein there is a space (25) between said tube handle and said holder to facilitate gripping of said tube handle.

10. A vacuum cleaner assembly according to claim 1, wherein said holder comprises a body having a first part (16) and a second part (17), said first part comprising a plurality of walls (18, 19, 20, 21) which cooperate to define first and second pockets (26, 33), said first pocket being adapted to receive and retain a first vacuum cleaner nozzle and said second pocket being adapted to receive and retain a second vacuum cleaner nozzle, wherein said walls include members (26, 29, 37) which cooperate to releasably retain said first and second nozzles in said first and second pockets.

11. A vacuum cleaner assembly according to claim 10, wherein said second part defines a third pocket (38) which is adapted to receive and frictionally retain a brush nozzle.

12. A vacuum cleaner assembly according to claim 10, wherein said members include a shoulder (28) which extends into said first pocket and is received by an open end of said first nozzle.

13. A vacuum cleaner assembly according to claim 10, wherein said walls include upper and lower wall portions (19), a front wall portion (20), and a rear wall portion (21).

14. A vacuum cleaner assembly according to claim 13, wherein said walls include a plate (18), said plate extending between said upper and lower wall portions and serving to separate said first pocket from said second pocket.

15. A vacuum cleaner assembly according to claim 13, wherein said members include a plurality of resilient projections (29, 37) which extend from said upper and lower wall portions.

16. A vacuum cleaner assembly according to claim 13, wherein said members include a shoulder (28) which extends into said first pocket and is received by an open end of said first nozzle.

17. A vacuum cleaner assembly according to claim 10, wherein said holder includes a resilient fastener (24), said fastener being adapted to releasably secure the holder to a tubular member.

18. A holder for vacuum cleaner nozzles, comprising a body having a first part (16) and a second part (17), said first part comprising a plurality of walls (18, 19, 20, 21) which cooperate to define first and second pockets (26, 33), said first pocket being adapted to receive and retain a first vacuum cleaner nozzle and said second pocket being adapted to receive and retain a second vacuum cleaner nozzle, wherein said walls include upper and lower wall portions (19), a front wall portion (20), a rear wall portion (21), and members (26, 29, 37), said members cooperating to releasably retain said first and second nozzles in said first and second pockets, said members including a shoulder (28) which extends into said first pocket and is received by an open end of said first nozzle, wherein said second part defines a third pocket (38) which is adapted to receive and frictionally retain a brush nozzle.

19. A holder according to claim 18, wherein said members include a plurality of resilient projections (29, 37) which extend from said upper and lower wall portions.

20. A holder according to claim 19, further comprising a resilient fastener (24), said fastener being adapted to releasably secure the holder to a tubular member.

* * * * *